US009900959B2

(12) United States Patent
Park

(10) Patent No.: US 9,900,959 B2
(45) Date of Patent: Feb. 20, 2018

(54) LIGHT EMITTING PAPER AND METHOD OF FORMING THE SAME

(71) Applicant: ELECTRONICS AND TELECOMMUNICATIONS RESEARCH INSTITUTE, Daejeon (KR)

(72) Inventor: Rae-Man Park, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/255,256

(22) Filed: Sep. 2, 2016

(65) Prior Publication Data

US 2017/0142806 A1 May 18, 2017

(30) Foreign Application Priority Data

Nov. 13, 2015 (KR) ..... 10-2015-0159863

(51) Int. Cl.

| | |
|---|---|
| ***H05B 33/20*** | (2006.01) |
| ***H05B 33/10*** | (2006.01) |
| ***H05B 33/14*** | (2006.01) |
| ***H05B 33/28*** | (2006.01) |

(52) U.S. Cl.

CPC ..... *H05B 33/20* (2013.01); *H05B 33/10* (2013.01); *H05B 33/145* (2013.01); *H05B 33/28* (2013.01)

(58) Field of Classification Search

CPC ..... H05B 33/20; H05B 33/28; H05B 33/10; H05B 33/145

See application file for complete search history.

(56) References Cited

U.S. PATENT DOCUMENTS

2012/0154900 A1 6/2012 Kim
2013/0163067 A1 6/2013 Kim et al.

FOREIGN PATENT DOCUMENTS

KR 10-2008-0090781 A 10/2008
WO WO-2008/123643 A1 10/2008

OTHER PUBLICATIONS

Juan Xue, et al., "Let It Shine: A Transparent and Photoluminescent Foldable Nanocellulose/Quantum Dot Paper", ACS Appl. Mater. Interfaces, vol. 7, pp. 10076-10079, May 2015.

*Primary Examiner* — Joseph L Williams
(74) *Attorney, Agent, or Firm* — Rabin & Berdo, P.C.

(57) ABSTRACT

This light emitting paper includes a first transparent electrode, a second transparent electrode on the first transparent electrode, a cellulose layer between the first and second transparent electrodes, and light emitting particles in the cellulose layer. The cellulose layer includes cellulose nanofibrils having nanoscale diameters. Each of the light emitting particles includes one of a metal oxide, a metal sulfide, and a metal sulfur oxide and a dopant doped thereinto.

16 Claims, 15 Drawing Sheets

LIGHT EMITTING PAPER AND METHOD OF FORMING THE SAME

CROSS-REFERENCE TO RELATED APPLICATION

This U.S. non-provisional patent application claims priority under 35 U.S.C. § 119 of Korean Patent Application No. 10-2015-0159863, filed on Nov. 13, 2015, the entire contents of which are hereby incorporated by reference.

BACKGROUND

The present disclosure herein relates to a paper and a method of forming the same, and more particularly, to a light emitting paper and a method of forming the same.

In a broad sense, paper refers to an object formed such that vegetable fibers are dispersed in water to be flattened and entangled with each other and are then dried. Paper in a broad sense is roughly classified into Korean paper and foreign paper, Korean paper is classified into hand-made paper and machine-made paper, and foreign paper is classified into paper in a narrow sense and paperboard. Korean paper is formed mainly of bast fibers such as mulberry, hemp, or yam, and foreign paper is formed mainly of wood pulp.

Among foreign paper, paper in a narrow sense is formed by drying a single-layered fiber, and paperboard is formed by pressing multi-ply fiber layers. Wood pulp, which is a main material for paper (foreign paper), is mainly composed of cellulose fibers, and cellulose fibers strongly bind together through a hydrogen bond. In general, the length of a cellulose fiber is much greater than the diameter thereof, and cellulose fibers have micrometer-scale diameters.

Paper in a narrow sense is mainly used as a means for leaving behind records, and Korean paper is used only for lampshades, window papers, or the like, but is not directly used as a functional element.

SUMMARY

The present disclosure provides a light emitting paper and a method of forming the same, the paper emitting light from both surfaces thereof.

An embodiment of the inventive concept provides a light emitting paper including: a first transparent electrode, a second transparent electrode on the first transparent electrode, a cellulose layer between the first and second transparent electrodes, and light emitting particles in the cellulose layer. The cellulose layer may include cellulose nanofibrils having nanoscale diameters. Each of the light emitting particles may include one of a metal oxide, a metal sulfide, and a metal sulfur oxide and a dopant doped thereinto.

In an embodiment, the ratio of the light emitting particles 110 in the cellulose layer 100 may be about 10 wt % to about 50 wt %.

In an embodiment, the dopant may include at least one of manganese (Mn), copper (Cu), silver (Ag), or europium (Eu).

In an embodiment, each of the metal oxide, metal sulfide, and metal sulfur oxide may include at least one metal element of zinc (Zn), yttrium (Y), aluminum (Al), barium (Ba), or gallium (Ga).

In an embodiment, the diameter of each of the cellulose nanofibrils may be about 30 nm or less.

In an embodiment, each of the first and second transparent electrodes may include a silver nanowire.

In an embodiment, each of the first and second transparent electrodes may include a metal oxide.

In an embodiment, each of the first and second transparent electrodes may include at least one metal element of aluminum (Al), zinc (Zn), or tin (Sn).

In an embodiment, each of the first and second transparent electrodes may include a conductive organic substance.

In an embodiment, the thickness of the light emitting paper may be About 30 μm to about 200 μm.

In an embodiment of the inventive concept, a method for forming a light emitting paper includes: preparing a first aqueous solution in which cellulose nanofibrils and light emitting particles are mixed; preparing a first filter film comprising a plurality of openings; filtering the cellulose nanofibrils and the light emitting particles from the first aqueous solution by using the first filter film to form a cellulose layer including the light emitting particles therein on the first filter film.

In an embodiment, the method for forming a light emitting paper may further include forming a first transparent electrode on one surface of the first filter film before forming the cellulose layer. The cellulose layer may be formed by filtering the cellulose nanofibrils and the light emitting particles from the first aqueous solution by using the first filter film on which the first transparent electrode is formed. The first transparent electrode may be interposed between the first filter film and the cellulose layer.

In an embodiment, the forming of the first transparent electrode may include: preparing a second aqueous solution including a silver nanowire; and filtering the silver nanowire from the second aqueous solution by using the first filter film before forming the cellulose layer.

In an embodiment, the method for forming a light emitting paper may further include: preparing a second filter film having a plurality of openings; forming a second transparent electrode on one surface of the second filter film; and providing the second filter film on which the second transparent electrode is formed on the cellulose layer. The cellulose layer may be interposed between the first and second filter films, and the second transparent electrode may be interposed between the second filter film and the cellulose layer.

In an embodiment, the method for forming a light emitting paper may further include respectively removing the first and second filter films from the first and second transparent electrodes.

In an embodiment, the forming of the second transparent electrode may include: preparing a second aqueous solution including a silver nanowire; and filtering the silver nanowire from the second aqueous solution by using the second filter film.

In an embodiment, the cellulose layer may be formed on one surface of the first filter film. The method may further include: removing the first filter film from the cellulose layer; and forming first and second transparent electrodes respectively on both surfaces of the cellulose layer, after removing the first filter film.

In an embodiment, each of the first and second transparent electrodes may include a metal oxide or a conductive organic substance. Each of the first and second transparent electrodes may be formed by using at least one of sputtering method, an evaporation deposition method, or a spin-coating method.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIGS. 9A to 11A are plan views for describing a method of forming light emitting paper according to an embodiment of the inventive concept;

FIGS. 9B to 11B are cross-sectional views taken along lines I-I' of FIGS. 9A to 11A;

DETAILED DESCRIPTION

In order to provide a further understanding of the inventive concept, exemplary embodiments of the present disclosure will be described in detail with reference to the accompanying drawings. The inventive concept may, however, be embodied in many alternate forms and should not be construed as limited to only the embodiments set forth herein. Rather, these embodiments are provided so that this disclosure will be thorough and complete, and will fully convey the scope of the present disclosure to those skilled in the art. In the accompanying drawings, the dimensions of the elements are enlarged for effective description of the technical contents, and the ratio of the elements may be exaggerated or reduced.

Unless otherwise defined, all terms used herein may have the same meaning as commonly understood by one of ordinary skill in the art to which this invention belongs. Hereinafter, the present disclosure will be described in detail by explaining preferred embodiments of the invention with reference to the accompanying drawings.

Figure 1:
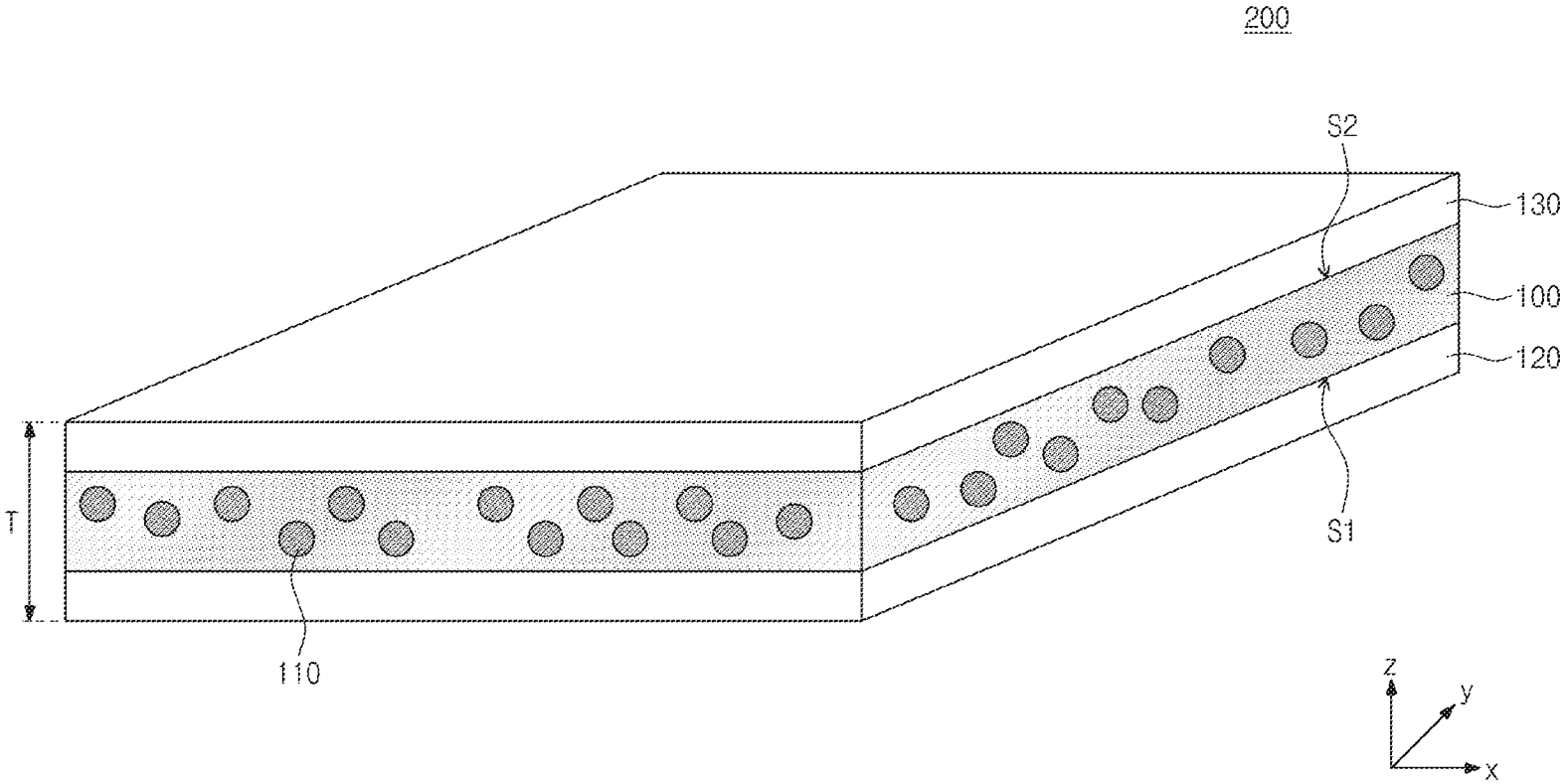
FIG. 1 is a perspective view for describing light-emitting paper according to an embodiment of the inventive concept.
Figure 2:
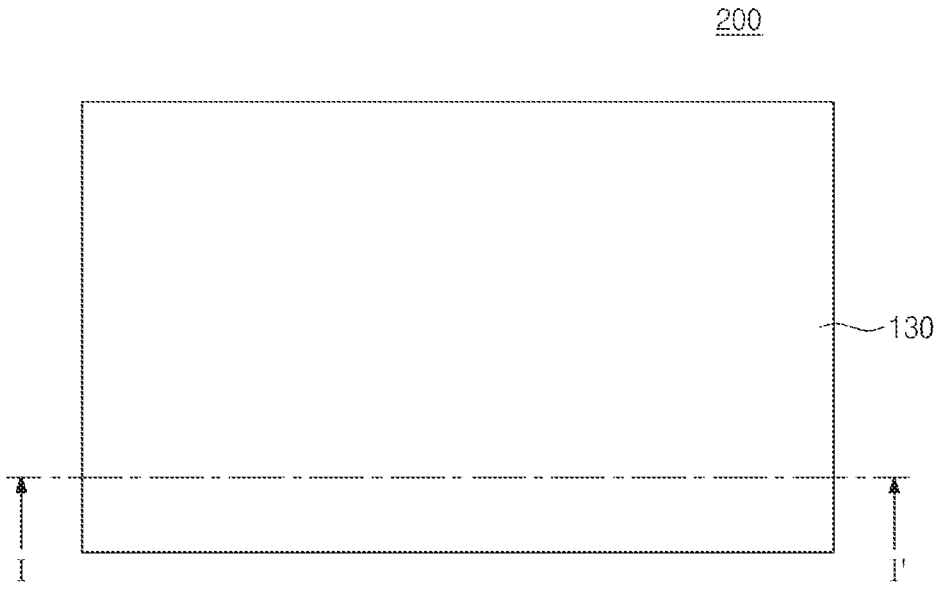
FIG. 2 is a plan view for describing light-emitting paper according to an embodiment of the inventive concept.

FIG. 1 is a perspective view for describing light-emitting paper according to an embodiment of the inventive concept. FIG. 2 is a plan view for describing light-emitting paper according to an embodiment of the inventive concept, FIG. 3 is a cross-sectional view taken along line I-I' of FIG. 2, FIG. 4 is a plan view for describing a cellulose layer according to an embodiment of the inventive concept, and FIG. 5 is a plan view for describing a transparent electrode according to an embodiment of the inventive concept.

Figure 3:
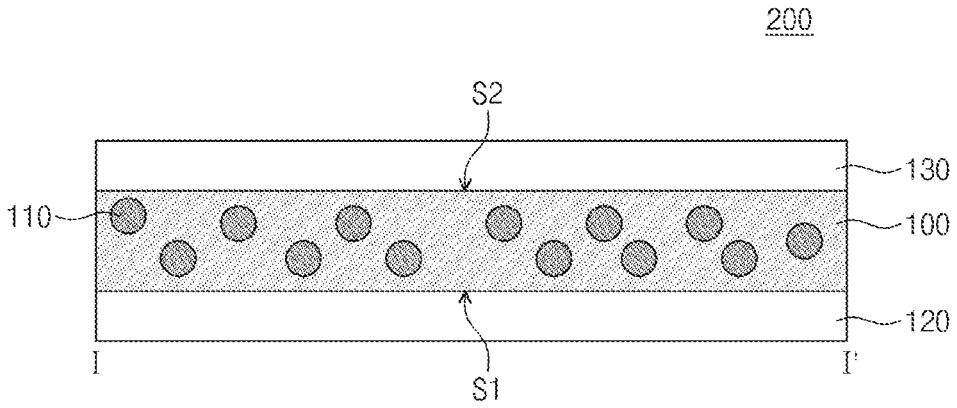
FIG. 3 is a cross-sectional view taken along line I-I' of FIG. 2.

Referring to FIGS. 1 to 3, a light emitting paper 200 may include a cellulose layer 100, light emitting particles 110 scattered in the cellulose layer 100, and first and second transparent electrodes 120 and 130 which are spaced apart from each other with the cellulose layer 100 disposed therebetween. The cellulose layer 100 may have a plate-like shape which has a thickness (for example, a length in the z-direction) is smaller than a horizontal length (for example, a length in x- or y-direction). The cellulose layer 100 may have a first surface S1 and a second surface S2 which face each other, and each of the first and second surfaces S1 and S2 may be an xy-plane. The first and second transparent electrodes 120 and 130 may be respectively provided on the first and second surfaces S1 and S2 of the cellulose layer 100.

Figure 4:
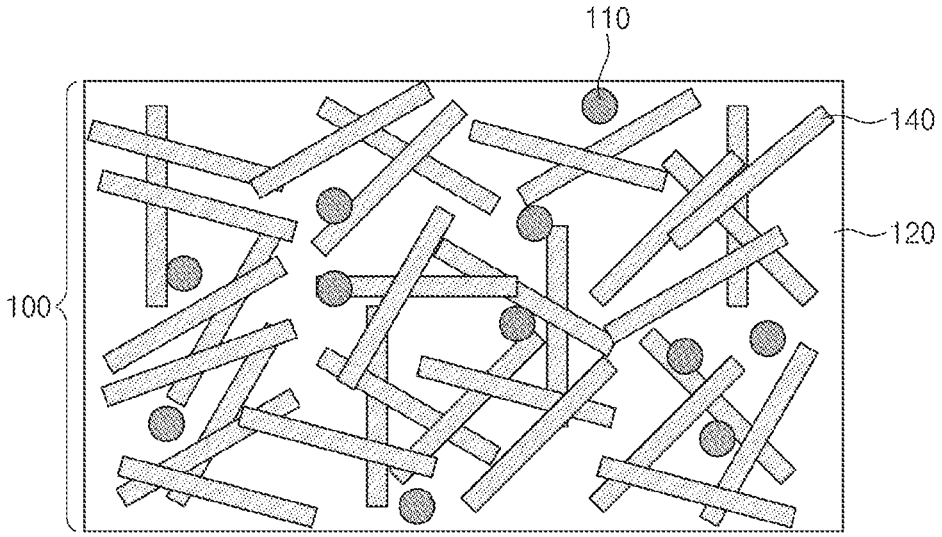
FIG. 4 is a plan view for describing a cellulose layer according to an embodiment of the inventive concept.
Figure 5:
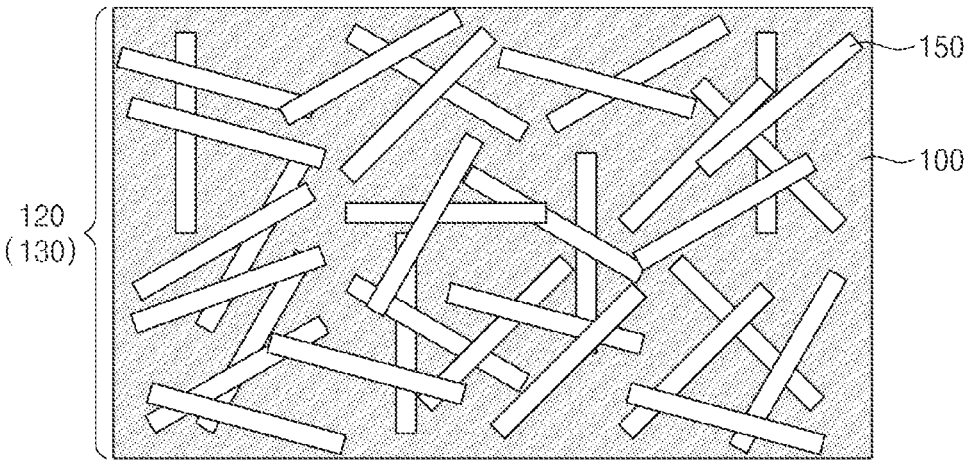
FIG. 5 is a plan view for describing a transparent electrode according to an embodiment of the inventive concept.

Referring to FIG. 4, the cellulose layer 100 may be composed of cellulose nanofibrils 140 provided on the first transparent electrode 120. Each of the cellulose nanofibrils 140 may have a nanoscale diameter. For example, the diameter of each of the cellulose nanofibrils 140 may be about 30 nm or less.

The light emitting particles 110 may be scattered among the cellulose nanofibrils 140. The ratio of the light emitting particles 110 in the cellulose layer 100 may be about 10 wt % to about 50 wt %.

Each of the light emitting particles 110 may include one of a metal oxide, a metal sulfide, or a metal sulfur oxide. Each of the metal oxide, metal sulfide, and metal sulfur oxide may include, for example, at least one metal element of zinc (Zn), yttrium (Y), aluminum (Al), barium (Ba), or gallium (Ga). Each of the light emitting particles 110 may further include a dopant. The dopant may include, for example, at least one of manganese (Mn), copper (Cu), silver (Ag), or europium (Eu). For example, each of the light emitting particles 110 may be a zinc sulfide (ZnS) doped with manganese (Mn).

Referring to FIG. 5, each of the first and second transparent electrodes 120 and 130 may be composed of silver nanowires 150 provided on the cellulose layer 100. The diameter of each of the silver nanowires 150 may be, for example, about 20 nm to about 30 nm, and the length of each of the silver nanowires 150 may be, for example, about 20 μm to about 30 μm.

Referring again to FIGS. 1 to 3, the thickness T of the light emitting paper 200 may be about 30 μm to about 200 μm.

As a voltage is applied to the first and second transparent electrodes 120 and 130, an electric field may be applied to the cellulose layer 100. For example, when each of the light emitting particles 110 is a zinc sulfide (ZnS) doped with manganese (Mn), conduction band electrons of the zinc sulfide (ZnS) may be accelerated by the electric field, and the accelerated electrons may collide with the manganese (Mn) which is a dopant. In this case, the electrons in the Mn atom are excited through colliding with the accelerated electrons and are then returned again to an original energy level thereof. As the electrons in the Mn atom are returned to original energy levels thereof, light may be generated from each of the light emitting particles 110. The light generated from each of the light emitting particles 110 may be emitted to the outside through the first and second transparent electrodes 120 and 130. Accordingly, light may be emitted from both surfaces of the light emitting paper 200.

The voltage applied to the first and second transparent electrodes 120 and 130 may be an alternating voltage. The greater the amount of voltage applied to the first and second transparent electrodes 120 and 130, the greater the brightness of the light emitted from the light emitting paper 200, and the greater the frequency of the voltage, the shorter the wavelength of the light emitted from the light emitting paper may be changed.

Figure 6:
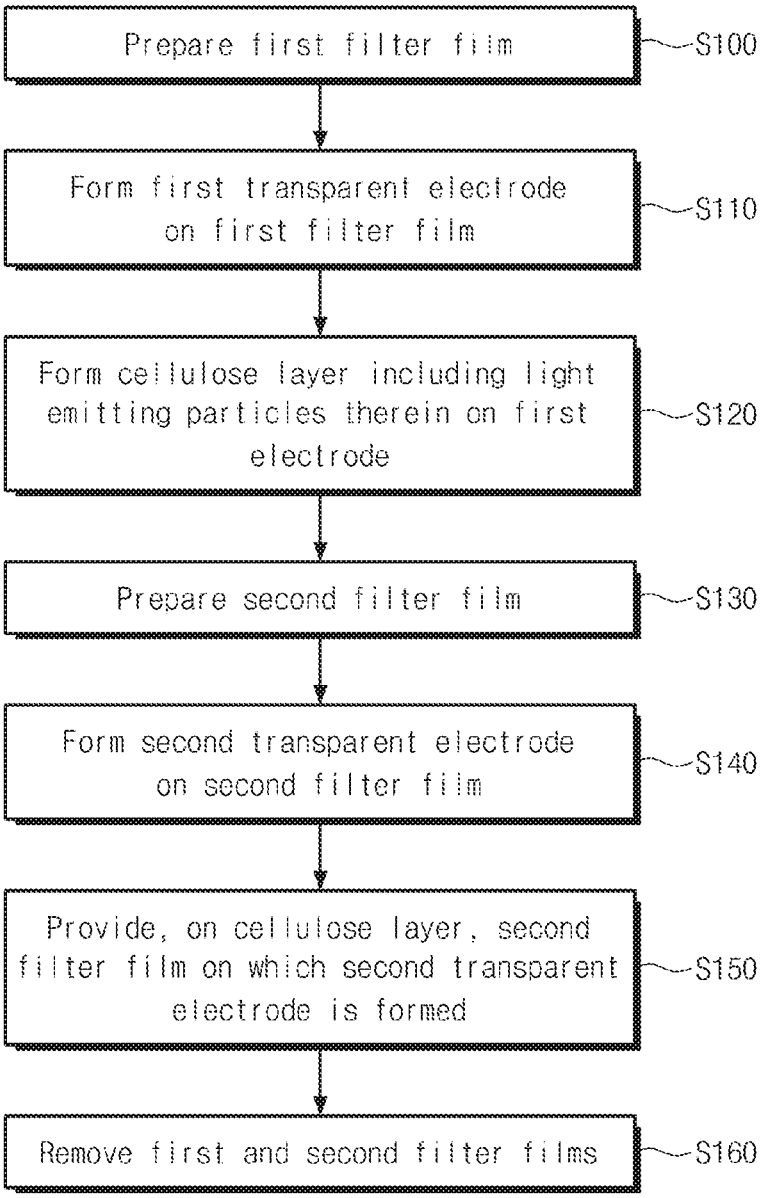
FIG. 6 is a flowchart for describing a method of forming light emitting paper according to an embodiment of the inventive concept.
Figure 7:
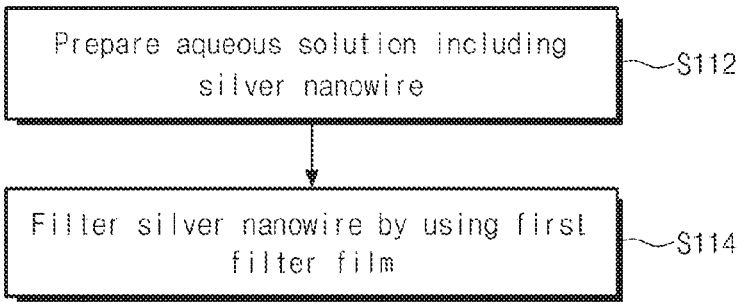
FIG. 7 is a flow chart for describing step S110 of FIG. 6.
Figure 8:
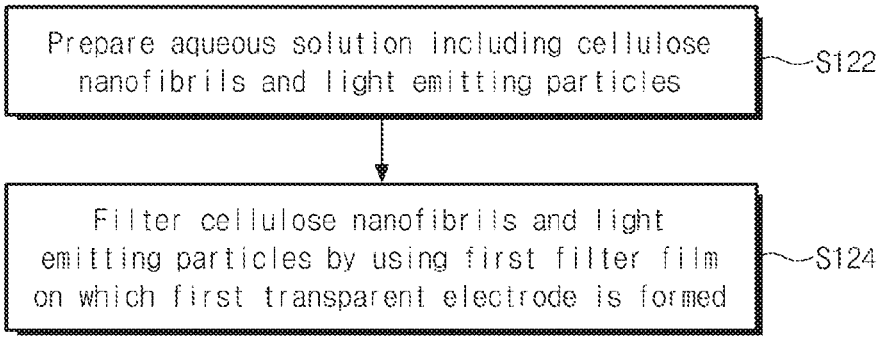
FIG. 8 is a flow chart for describing step S120 of FIG. 6.
Figure 9A:
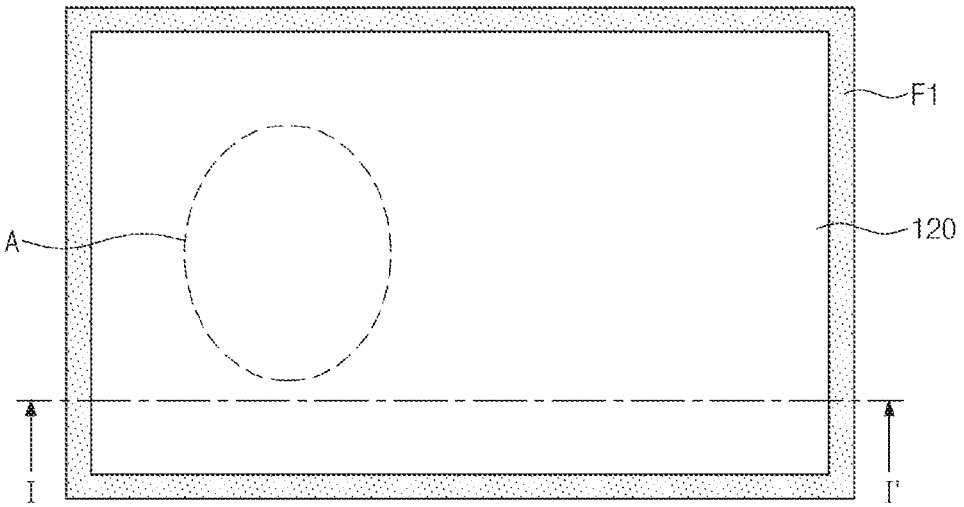
Figure 9B:
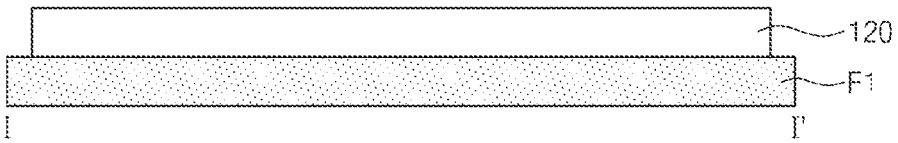
Figure 10A:
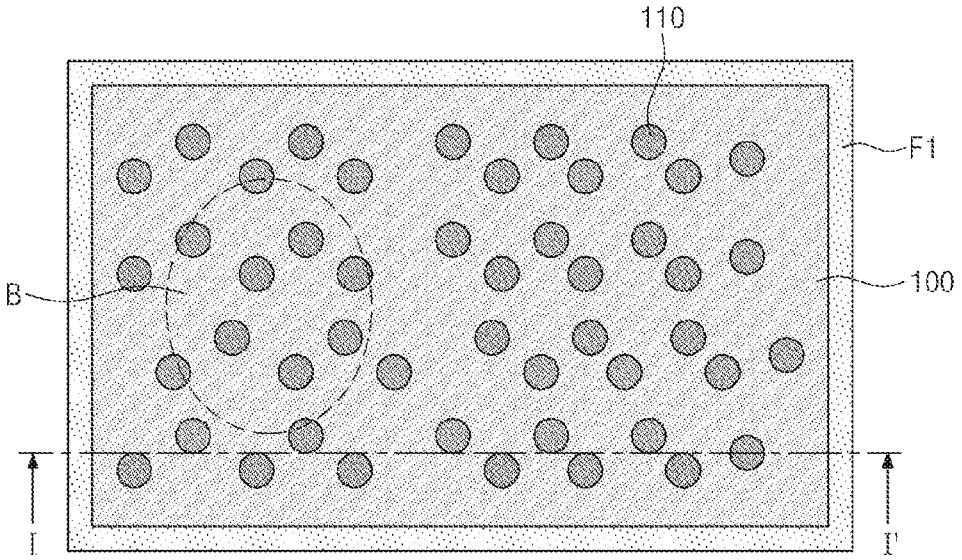
Figure 10B:
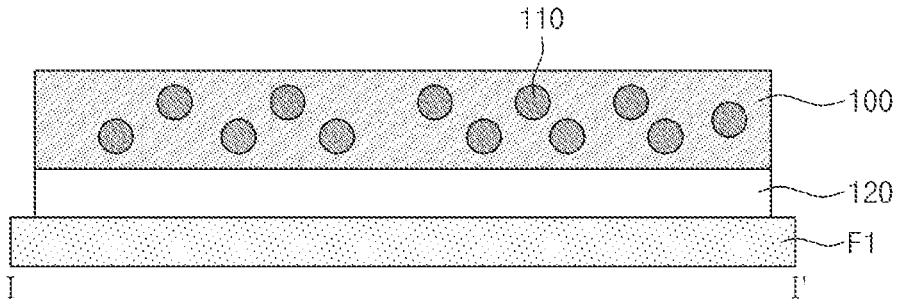
Figure 12:
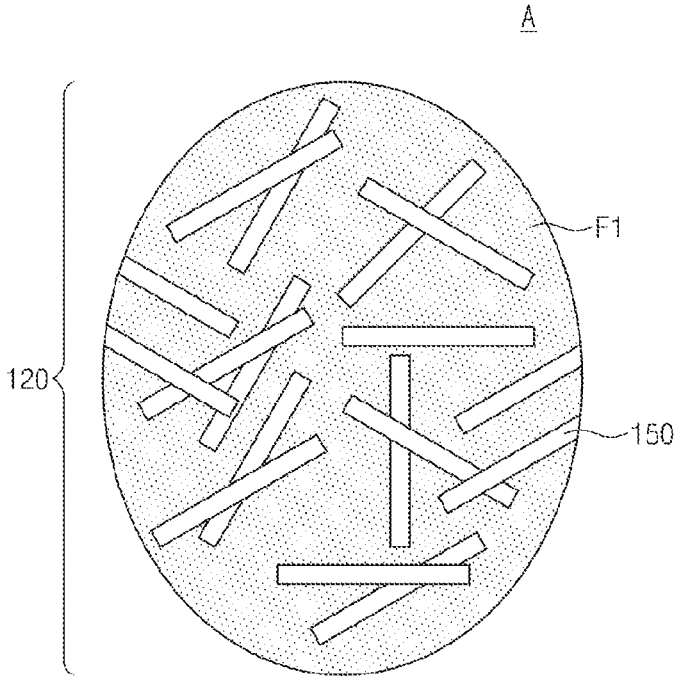
FIG. 12 is an enlarged view illustrating region A of FIG. 9A.
Figure 13:
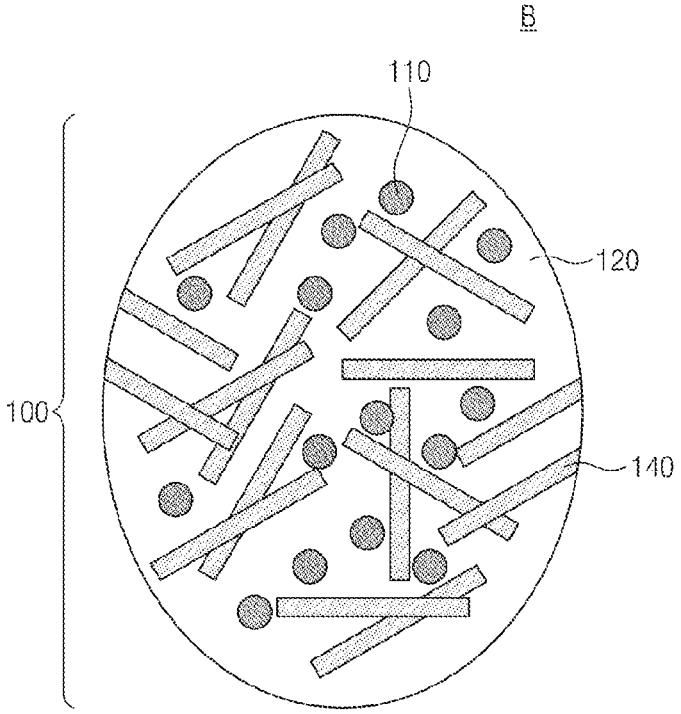
FIG. 13 is an enlarged view illustrating region B of FIG. 10A.
Figure 14:
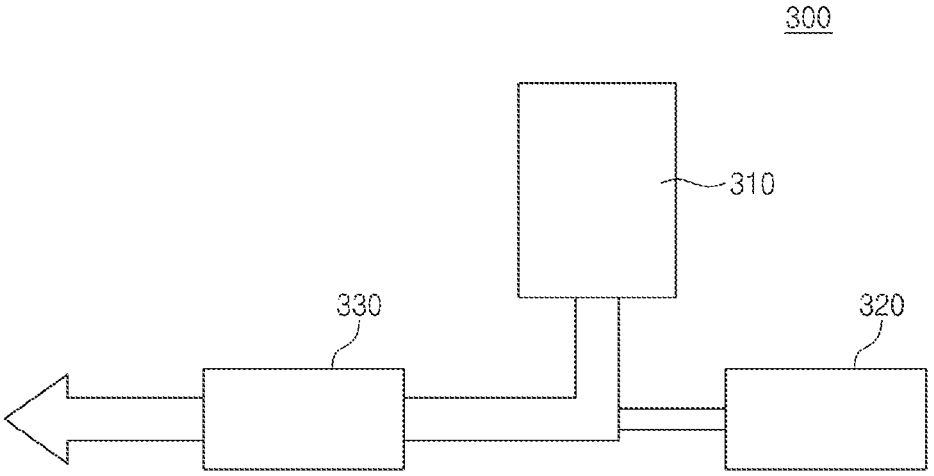
FIG. 14 is a schematic view for describing a method for forming cellulose nanofibrils.

FIG. 6 is a flowchart for describing a method of forming light emitting paper according to an embodiment of the inventive concept. FIG. 7 is a flow chart for describing step S110 of FIG. 6, and FIG. 8 is a flow chart for describing step S120 of FIG. 6. FIGS. 9A to 11A are plan views for describing a method of forming light emitting paper according to an embodiment of the inventive concept, and FIGS. 9B to 11B are cross-sectional views taken along lines I-I' of FIGS. 9A to 11A. FIG. 12 is an enlarged view illustrating region A of FIG. 9A, and FIG. 13 is an enlarged view illustrating region B of FIG. 10A. FIG. 14 is a schematic view for describing a method for forming cellulose nanofibrils.

Referring to FIGS. 6, 7, 9A, 9B, and 12, firstly, a first filter film F1 may be provided (S100). The first filter film F1 may have a plurality of openings, and the diameter of each of the openings may be about 0.2 μm to about 1 μm. The first filter film F1 may include, for example, polyvinylidene fluoride (PVDF).

A first transparent electrode 120 may be formed on the first filter film F1 (S110). As illustrated in FIG. 12, the first transparent electrode 120 may be composed of silver nanowires 150 provided on the first filter film F1.

Referring to FIG. 7, the forming of the first transparent 120 may include preparing an aqueous solution including the silver nanowires 150 (S112), and filtering the silver nanowires 150 from the aqueous solution by using the first filter film F1 (S114). Accordingly, the first transparent electrode 120 may be formed on one surface of the first filter film F1.

Referring to FIGS. 6, 8, 10A, 10B, and 13, a cellulose layer 100 including light emitting particles 110 therein may be formed on the first transparent electrode 120 (S120). As illustrated in FIG. 13, the cellulose layer 100 may be composed of cellulose nanofibrils 140 provided on the first transparent electrode 120. Each of the cellulose nanofibrils 140 may have a nanoscale diameter. For example, the diameter of each of the cellulose nanofibrils 140 may be about 30 nm or less. The light emitting particles 110 may be scattered among the cellulose nanofibrils 140.

Referring to FIG. 8, the forming of the cellulose layer 100 may include preparing an aqueous solution including the cellulose nanofibrils 140 and the light emitting particles 110 (S122).

Specifically, the cellulose nanofibrils 140 may be firstly prepared. The cellulose nanofibrils 140 may be formed by pulverizing cellulose fibers having micrometer-scale diameters at a high pressure. For example, cellulose fibers having diameters of about 20 μm may be immersed in a basic aqueous solution and in an aqueous solution of salt dioxide ($NaClO_2$) at about 70° C. for about two hours. Subsequently, the cellulose fiber may be introduced into a material input port 310 of a high-pressure dispersion equipment 300 illustrated in FIG. 14. A high-pressure pump 320 of the high-pressure dispersion equipment 300 may apply a high pressure into the high-pressure dispersion equipment 300, and the cellulose fiber may pass through a micro-nozzle part 330 with a pressure of about 1500 atmospheres (Bar). The cellulose fiber may pass through the high-pressure dispersion equipment 300 about 10 times to 20 times to be pulverized into the cellulose nanofibrils 140 having diameters of about 30 nm or less.

Subsequently, the light emitting particles 110 may be prepared. Each of the light emitting particles 110 may include one of a metal oxide, a metal sulfide, or a metal sulfur oxide. Each of the metal oxide, metal sulfide, and metal sulfur oxide may include, for example, at least one metal element of zinc (Zn), yttrium (Y), aluminum (Al), barium (Ba), or gallium (Ga). Each of the light emitting particles 110 may further include a dopant. The dopant may include, for example, at least one of manganese (Mn), copper (Cu), silver (Ag), or europium (Eu). For example, each of the light emitting particles 110 may be a zinc sulfide (ZnS) doped with manganese (Mn).

The aqueous solution may be prepared by adding the cellulose nanofibrils 140 and the light emitting particles 110 into water.

Referring again to FIG. 7, the forming of the cellulose layer 100 may include filtering the cellulose nanofibrils 140 and the light emitting particles 110 from the aqueous solution by using the first filter film F1 on which the first transparent electrode 120 is formed (S124).

Specifically, the aqueous solution including the cellulose nanofibrils 140 and the light emitting particles 110 may be provided on one surface of the first filter film F1 on which the first transparent 120 is formed. In this case, water molecules may pass through the first transparent 120 and the first filter film F1, but the cellulose nanofibrils 140 and the light emitting particles 110 may be filtered by the first transparent 120 and the first filter film F1 to remain on the first transparent electrode 120.

Accordingly, the cellulose layer 100 including light emitting particles 110 therein may be formed on the first transparent electrode 120. The first transparent electrode 120 may be interposed between the first filter film F1 and the cellulose layer 100.

Figure 11A:
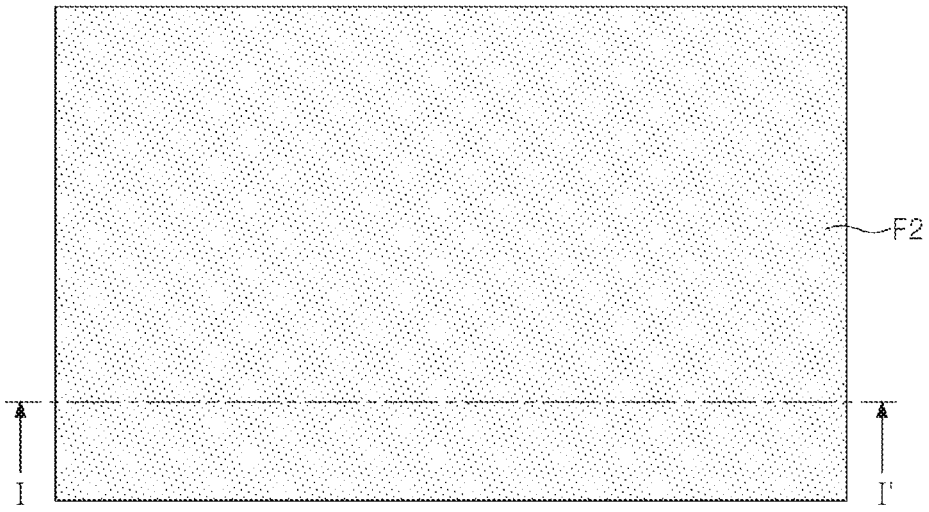
Figure 11B:
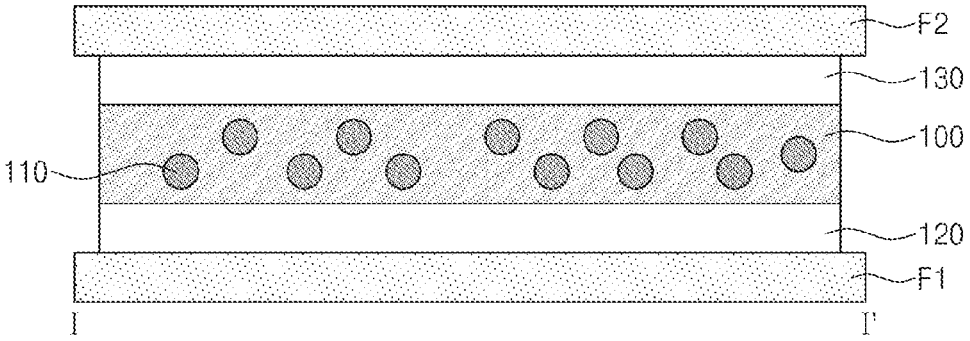

Referring to FIGS. 6, 11A, and 11B, a second filter film F2 may be prepared (S130). The second filter film F2 may have a plurality of openings, and the diameter of each of the openings may be about 0.2 μm to about 1 μm. The second filter film F2 may include, for example, polyvinylidene fluoride (PVDF).

A second transparent electrode 130 may be formed on the second filter film F2 (S140). The second transparent electrode 130 may be composed of silver nanowires 150 provided on the second filter film F2 like the first transparent electrode 120 described with reference to FIG. 12. The forming of the second transparent 130 may be substantially the same as the method of forming the first transparent electrode 120 described with reference to FIG. 7. That is, the forming of the second transparent 130 may include preparing an aqueous solution including the silver nanowires 150, and filtering the silver nanowires 150 from the aqueous solution by using the second filter film F2. Accordingly, the second transparent electrode 130 may be formed on one surface of the second filter film F2.

The second filter film F2 on which the second transparent electrode 130 is formed may be provided on the cellulose layer 100 (S150). The second filter film F2 may be provided so as to be spaced apart from the cellulose layer 100 with the second transparent electrode 130 disposed therebetween.

The cellulose layer 100 may be interposed between the first filter film F1 and the second filter film F2, and the first transparent electrode 120 may be interposed between the first filter film F1 and the cellulose layer 100. The second transparent electrode 130 may be interposed between the second filter film F2 and the cellulose layer 100. The cellulose layer 100, the first and second transparent electrodes 120 and 130, and the first and second filter films F1 and F2 may be defined as a stacked structure SS.

Referring to FIGS. 6, 2, and 3, the first and second filter films F1 and F2 may be respectively removed from the first and second transparent electrodes 120 and 130 (S160). For example, the stacked structure SS is pressed with a pressure of about 3 MPa to about 10 MPa for about 8 hours, and then the first and second filter films F1 and F2 may be physically removed. The removing of the first and second filter films F1 and F2 may further include applying a pressure on to the stacked structure SS and drying the stacked structure SS.

As the first and second filter films F1 and F2 are removed, a light emitting paper 200 including the first and second transparent electrodes 120 and 130, the cellulose layer 100, and the light emitting particles 110 scattered in the cellulose layer 100.

Figure 15:
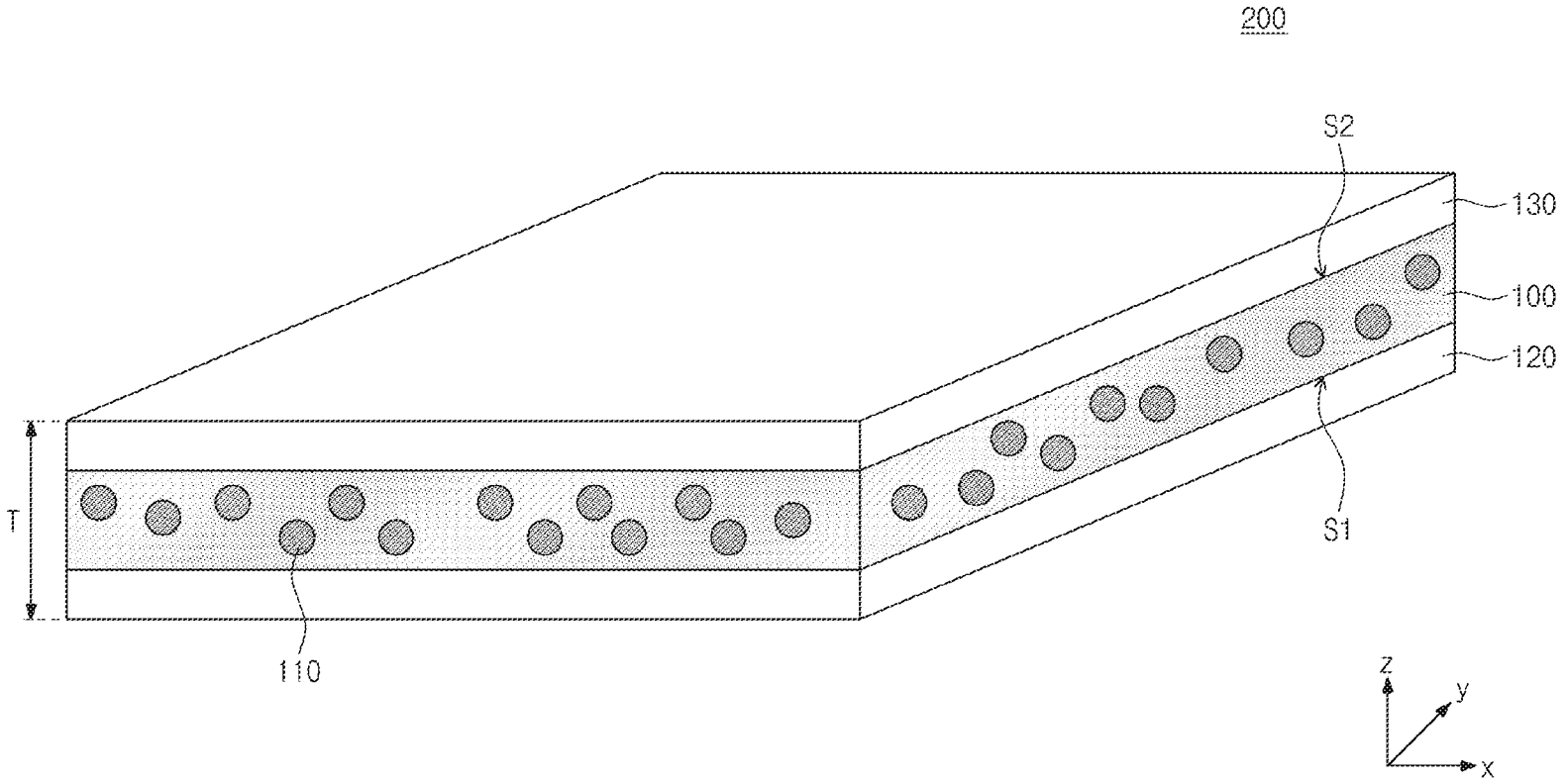
FIG. 15 is a perspective view for describing light-emitting paper according to another embodiment of the inventive concept.
Figure 16:
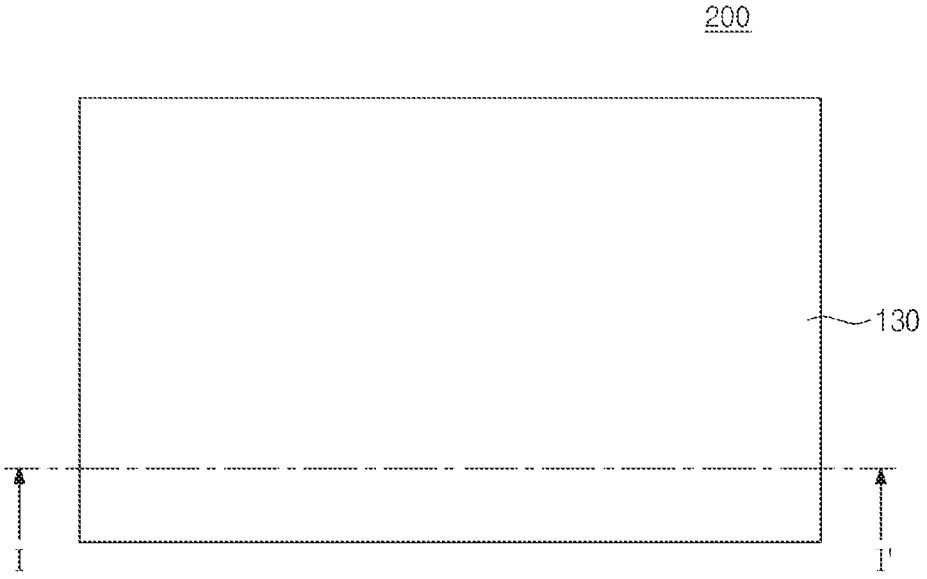
FIG. 16 is a plan view for describing light-emitting paper according to another embodiment of the inventive concept.
Figure 17:
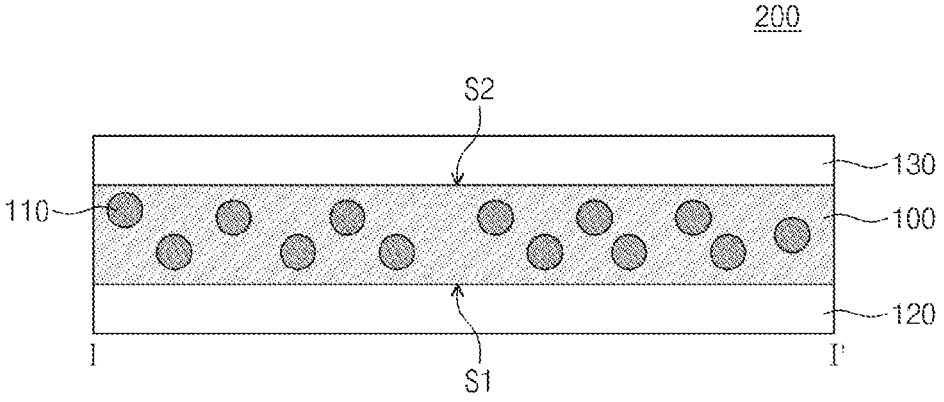
FIG. 17 is a cross-sectional view taken along line I-I' of FIG. 16.

FIG. 15 is a perspective view for describing light emitting paper according to another embodiment of the inventive concept. FIG. 16 is a plan view for describing light emitting paper according to another embodiment of the inventive concept, and FIG. 17 is a cross-sectional view taken along line I-I' of FIG. 16. Like reference numbers refer to like configurations as the light emitting paper according to an embodiment of the inventive concept, and overlapping descriptions may not be provided for convenience in description.

Referring to FIGS. 15 to 17, light emitting paper 200 may include a cellulose layer 100, light emitting particles 110 scattered in the cellulose layer 100, and first and second transparent electrodes 120 and 130 which are spaced apart from each other with the cellulose layer 100 disposed therebetween. The cellulose layer 100 may have a plate-like shape which has a thickness (for example, a length in the z-direction) is smaller than a horizontal length (for example, a length in x- or y-direction). The cellulose layer 100 may have a first surface S1 and a second surface S2 which face each other, and each of the first and second surfaces S1 and S2 may be an xy-plane. The first and second transparent electrodes 120 and 130 may be respectively provided on the first and second surfaces S1 and S2 of the cellulose layer 100.

As described with reference to FIG. 4, the cellulose layer 100 may be composed of cellulose nanofibrils 140 provided on the first transparent electrode 120. Each of the cellulose nanofibrils 140 may have a nanoscale diameter.

The light emitting particles 110 may be scattered among the cellulose nanofibrils 140. Each of the light emitting particles 110 may include one of a metal oxide, a metal sulfide, or a metal sulfur oxide. Each of the metal oxide, metal sulfide, and metal sulfur oxide may include, for example, at least one metal element of zinc (Zn), yttrium (Y), aluminum (Al), barium (Ba), or gallium (Ga). Each of the light emitting particles 110 may further include a dopant. The dopant may include, for example, at least one of manganese (Mn), copper (Cu), silver (Ag), or europium (Eu).

According to the current embodiment, each of the first and second transparent electrodes 120 and 130 may include a metal oxide or a conductive organic substance. The metal oxide may include at least one metal element of aluminum (Al), zinc (Zn), or tin (Sn).

When each of the first and second transparent electrodes 120 and 130 includes a metal oxide, for example, each of the first and second transparent electrodes 120 and 130 may be a zinc oxide doped with metal. In this case, the doped metal element may be at least one of aluminum (Al), tin (Sn), gallium (Ga), or indium (In). When each of the first and second transparent electrodes 120 and 130 includes a metal oxide, in another example, each of the first and second transparent electrodes 120 and 130 may be a multi-layered film composed of a lower metal oxide layer/a silver layer/an upper metal oxide layer. In this case, each of the lower and upper metal oxide layers may include, for example, at least one metal element of aluminum (Al) or zinc (Zn).

Figure 18:
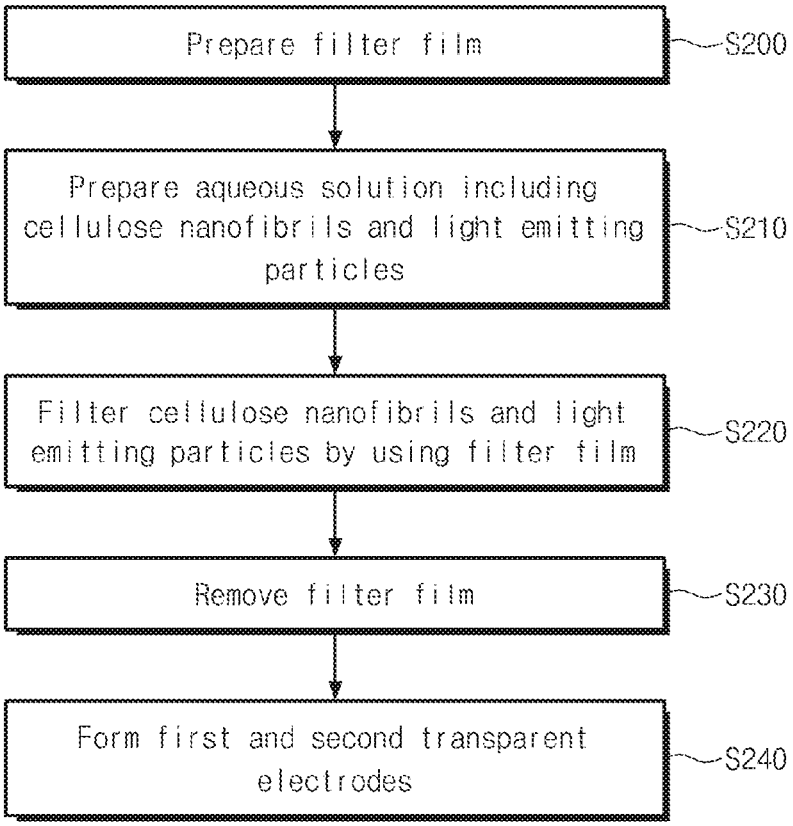
FIG. 18 is a flowchart for describing a method of forming light emitting paper according to another embodiment of the inventive concept.
Figure 19A:
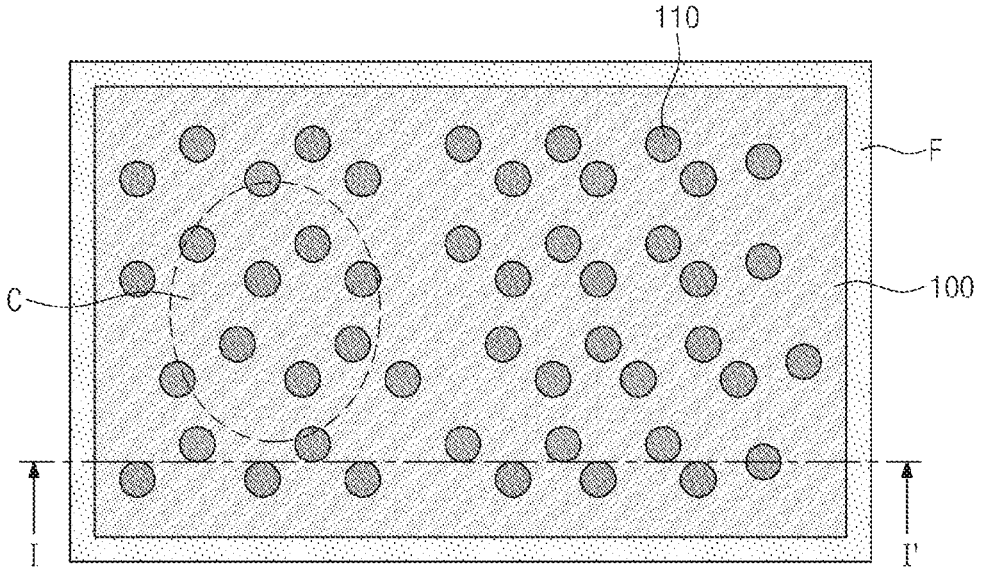
FIG. 19A is a plan view for describing a method of forming light emitting paper according to another embodiment of the inventive concept.
Figure 19B:
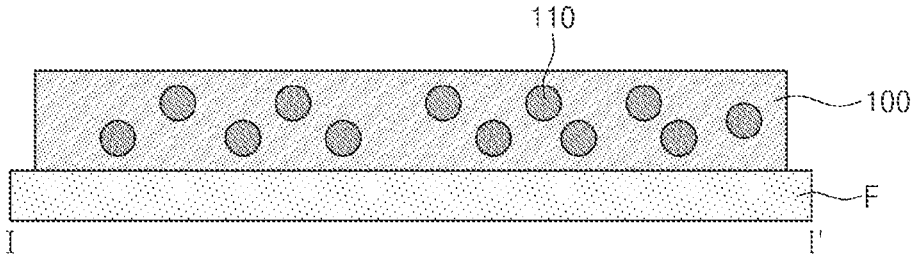
FIG. 19B is a cross-sectional view taken along line I-I' of FIG. 19A.
Figure 20:
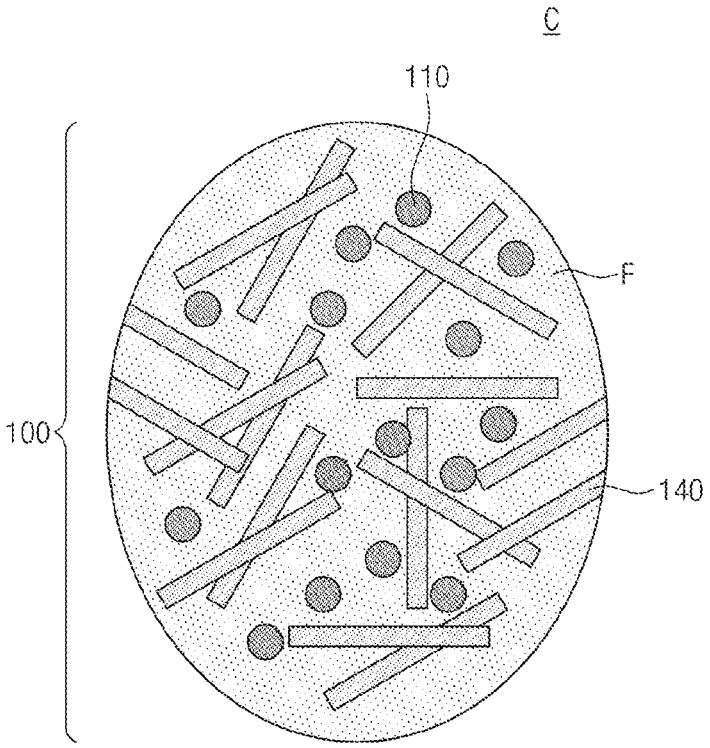
FIG. 20 is an enlarged view illustrating region C of FIG. 19A.

FIG. 18 is a flowchart for describing a method of forming light emitting paper according to another embodiment of the inventive concept. FIG. 19A is a plan view for describing a method of forming light emitting paper according to another embodiment of the inventive concept, and FIG. 19B is a cross-sectional view taken along line I-I' of FIG. 19A. FIG. 20 is an enlarged view illustrating region C of FIG. 19A. Like reference numbers refer to like configurations as the light emitting paper according to an embodiment of the inventive concept, and overlapping descriptions may not be provided for convenience in description.

Referring to FIGS. 18, 19A, 19B, and 20, firstly, a filter film F may be prepared (S200). The filter film F may have a plurality of openings, and the diameter of each of the openings may be about 0.2 μm to about 1 μm. The filter film F may include, for example, polyvinylidene fluoride (PVDF).

An aqueous solution including cellulose nanofibrils 140 and light emitting particles 110 may be prepared (S210). Specifically, the cellulose nanofibrils 140 may be firstly prepared. The cellulose nanofibrils 140 may be formed by pulverizing cellulose fibers having micrometer-scale diameters at a high pressure as described with reference to FIG. 14. Subsequently, the light emitting particles 110 may be prepared. Each of the light emitting particles 110 may include one of a metal oxide, a metal sulfide, or a metal sulfur oxide. Each of the metal oxide, metal sulfide, and metal sulfur oxide may include, for example, at least one metal element of zinc (Zn), yttrium (Y), aluminum (Al), barium (Ba), or gallium (Ga). Each of the light emitting particles 110 may further include a dopant. The dopant may include, for example, at least one of manganese (Mn), copper (Cu), silver (Ag), or europium (Eu). The aqueous solution may be prepared by mixing the cellulose nanofibrils 140 and the light emitting particles 110 into water.

The cellulose nanofibrils 140 and the light emitting particles 110 may be filtered from the aqueous solution by using the filter film F (S220). Specifically, the aqueous solution including the cellulose nanofibrils 140 and the light emitting particles 110 may be provided on one surface of the filter film F. In this case, water molecules may pass through the filter film F, but the cellulose nanofibrils 140 and the light emitting particles 110 may be filtered by the filter film F to remain on the filter film F. Accordingly, a cellulose layer 100 including the light emitting particles 110 therein may be formed on the one surface of the filter film F.

Referring to FIGS. 18, 16, and 17, the filter film F may be removed from the cellulose layer 100 (S230). The removing of the filter film F may include physically removing the filter film F from the cellulose layer 100 after drying the filter film F on which the cellulose layer 100 is formed.

Subsequently, first and second transparent electrodes 120 and 130 may be respectively formed on both surfaces S1 and S2 of the cellulose layer 100 (S240). Each of the first and second transparent electrodes 120 and 130 may include a metal oxide or a conductive organic substance. The metal oxide may include at least one metal element of aluminum (Al), zinc (Zn), or tin (Sn).

For example, each of the first and second transparent electrodes 120 and 130 may be formed by depositing a zinc oxide doped with metal. Here, the doped metal element may be at least one of aluminum (Al), tin (Sn), gallium (Ga), or indium (In). In this case, each of the first and second transparent electrodes 120 and 130 may be formed in a thickness of about 100 nm by using a sputtering method.

In another example, each of the first and second transparent electrodes 120 and 130 may be formed as a multi-layered film composed of a lower metal oxide layer/a silver (Ag) layer/an upper metal oxide layer. Here, each of the lower and upper metal oxide layers may include, for example, at least one metal element of aluminum (Al) or zinc (Zn). In this case, each of the first and second transparent electrodes 120 and 130 may be formed by using a sputtering method, and the lower metal oxide layer, the silver layer, and the upper metal oxide layer are respectively formed so as to have thicknesses of about 40 nm, about 10 nm, and about 40 nm.

When each of the first and second transparent electrodes 120 and 130 includes conductive substances, each of the first and second transparent electrodes 120 and 130 may be formed by using at least one of an evaporation deposition method or a spin-coating method.

As the first and second transparent electrodes 120 and 130 are formed, light emitting paper 200 including the first and second transparent electrodes 120 and 130, the cellulose layer 100, and the light emitting particles 110 scattered in the cellulose layer 100 may be formed.

According to the inventive concept, light emitting paper may have a new function of emitting light from both surfaces thereof by being applied a voltage to the surfaces while maintaining flexible and environment-friendly properties of paper.

The exemplary embodiments of the inventive concept have been described to provide examples of the inventive concept. Thus, it is understood that the present invention should not be limited to these exemplary embodiments but various changes and modifications can be made by one ordinary skilled in the art within the spirit and scope of the present invention as hereinafter claimed.

What is claimed is:

1. A light emitting paper comprising:

a first transparent electrode;

a second transparent electrode on the first transparent electrode;

a cellulose layer between the first and second transparent electrodes; and light emitting particles in the cellulose layer, wherein the cellulose layer includes cellulose nanofibrils having nanoscale diameters, and each of the light emitting particles includes one of a metal oxide, a metal sulfide, and a metal sulfur oxide and a dopant doped thereto.

2. The light emitting paper of claim 1, wherein the ratio of the light emitting particles in the cellulose layer is 10 wt % to 50 wt %.

3. The light emitting paper of claim 1, wherein each of the metal oxide, metal sulfide, and metal sulfur oxide comprises at least one metal element of zinc (Zn), yttrium (Y), aluminum (Al), barium (Ba), or gallium (Ga).

4. The light emitting paper of claim 1, wherein the diameter of each of the cellulose nanofibrils is 30 nm or less.

5. The light emitting paper of claim 1, wherein each of the first and second transparent electrodes comprises a silver nanowire.

6. The light emitting paper of claim 1, wherein each of the first and second transparent electrodes comprises a metal oxide.

7. The light emitting paper of claim 6, wherein each of the first and second transparent electrodes comprises at least one metal element of aluminum (Al), zinc (Zn), or tin (Sn).

8. The light emitting paper of claim 1, wherein each of the first and second transparent electrodes comprises a conductive organic substance.

9. A method for forming a light emitting paper, comprising:

preparing a first aqueous solution in which cellulose nanofibrils and light emitting particles are mixed;

preparing a first filter film comprising a plurality of openings; and filtering the cellulose nanofibrils and the light emitting particles from the first aqueous solution by using the first filter film to form a cellulose layer including the light emitting particles therein on the first filter film.

10. The method of claim 9, further comprising forming a first transparent electrode on one surface of the first filter film before forming the cellulose layer, wherein the cellulose layer is formed by filtering the cellulose nanofibrils and the light emitting particles from the first aqueous solution by using the first filter film on which the first transparent electrode is formed, and the first transparent electrode is interposed between the first filter film and the cellulose layer.

11. The method of claim 10, wherein the forming of the first transparent electrode comprises:

preparing a second aqueous solution including a silver nanowire; and filtering the silver nanowire from the second aqueous solution by using the first filter film before forming the cellulose layer.

12. The method of claim 10, further comprising:

preparing a second filter film having a plurality of openings;

forming a second transparent electrode on one surface of the second filter film; and providing the second filter film on which the second transparent electrode is formed on the cellulose layer, wherein the cellulose layer is interposed between the first and second filter films, and the second transparent electrode is interposed between the second filter film and the cellulose layer.

13. The method of claim 12, further comprising respectively removing the first and second filter films from the first and second transparent electrodes.

14. The method of claim 12, wherein the forming of the second transparent electrode comprises:

preparing a second aqueous solution including a silver nanowire; and filtering the silver nanowire from the second aqueous solution by using the second filter film.

15. The method of claim 9, wherein the cellulose layer is formed on one surface of the first filter film, the method further comprising:

removing the first filter film from the cellulose layer; and forming first and second transparent electrodes respectively on both surfaces of the cellulose layer, after removing the first filter film.

16. The method of claim 15, wherein each of the first and second transparent electrodes comprises a metal oxide or a conductive substance, wherein each of the first and second transparent electrodes is formed by using at least one of sputtering method, an evaporation deposition method, or spin-coating method.

* * * * *